United States Patent [19]

Zuliani

[11] Patent Number: 4,700,423

[45] Date of Patent: Oct. 20, 1987

[54] LAVATORY BRUSH

[75] Inventor: Alessandro Zuliani, Udine, Italy

[73] Assignee: Cosatto SpA, Martignacco, Italy

[21] Appl. No.: 761,634

[22] Filed: Aug. 1, 1985

[30] Foreign Application Priority Data

Sep. 3, 1984 [IT] Italy ..... 60436/84[U]

[51] Int. Cl.[4] ..... A46B 9/02

[52] U.S. Cl. ..... 15/160; 15/164; 15/236 R; 15/245; 15/187; 211/65; D4/128; D6/551; 248/110

[58] Field of Search ..... 15/104.16, 242, 176, 15/245, 236, 164, 165, 104.5, 121, 211, 186–188; 4/255; 248/110, 111; 211/65; D32/35; D4/116, 121, 128; D6/551, 116

[56] References Cited

U.S. PATENT DOCUMENTS

| | | | |
|---|---|---|---|
| D. 238,917 | 2/1976 | Vrignaud . | |
| D. 247,076 | 1/1978 | MacCollum | D4/128 X |
| D. 266,035 | 9/1982 | Thompson . | |
| D. 272,874 | 3/1984 | Cohen . | |
| D. 276,291 | 11/1984 | Boroch . | |
| D. 281,743 | 12/1985 | Thompson | D4/121 |
| 1,541,088 | 6/1925 | Whitenack | 15/245 |
| 2,026,680 | 1/1936 | Jacobson | 15/242 |
| 2,900,656 | 8/1959 | Tupper | 15/245 |
| 2,921,326 | 1/1960 | Lautmann | 15/145 |
| 2,966,688 | 1/1961 | Daubert | 15/104.16 X |
| 4,457,038 | 7/1984 | Hammond | 15/145 |

FOREIGN PATENT DOCUMENTS

| | | | |
|---|---|---|---|
| 615519 | 7/1935 | Fed. Rep. of Germany | 15/211 |
| 731297 | 5/1932 | France | 15/211 |
| 290515 | 5/1928 | United Kingdom | 15/188 |

*Primary Examiner*—Peter Feldman

*Attorney, Agent, or Firm*—Flynn, Thiel, Boutell & Tanis

[57] ABSTRACT

A lavatory brush comprising a handle and a plurality of axially stacked, laterally outwardly tapering, flexible blades, the blades extending around the handle. A container includes an upward opening cup and receives downward thereinto the bladed end of the handle. Cooperating alignment parts on the cup and handle releasably support the handle in an upright position with the blades in the cup. The topmost blade coacts with the side wall of the cup to substantially close the top of the cup with the remaining blades received in the cup.

20 Claims, 8 Drawing Figures

LAVATORY BRUSH

This invention concerns a lavatory brush. Many types of lavatory brushes are known which consist of brush elements or of plastic elements with inserted teeth or teeth consisting of a blade; it is also known that such brushes entail drawbacks linked to the retaining of the material to be cleaned, imperfect cleaning being performed after many passes with the brush.

Moreover, the known types of brush involve problems of their appearance after use and, where cleaning is not thorough, problems of unpleasant smells and sedimentation of material.

The present invention tends, therefore, to provide a lavatory brush particularly suitable for carrying out its tasks without creating problems of appearance, smells and speed of use, such brush being also easy to grasp and use in all circumstances.

According to the invention the brush consists of a handle comprising a handgrip and a protective cap.

An interchangeable body which can be fitted onto the body of the handle is provided in coordination with the protective cap.

Such interchangeable body comprises a cleaner body which consists of a plurality of cleaner blades having suitable dimensions and a characteristic razor-blade conformation. Such cleaner blades can be perfectly cylindrical or three-lobed or else ovoidal.

Moreover, according to the invention the cleaner blades can be continuous circumferentially or notched or can contain interruptions of their circumference.

Furthermore, the cleaner blades may be constituted as parallel disks or disks at an angle to each other or awry or disks with a coiled spiral form.

According to the invention a container, which comprises an area to retain dripping liquid and a stopper zone, cooperates with the lavatory brush.

The brush/container assemblage, which will be called hereinafter the "brush", possesses a pleasant, linear, clean appearance.

The container has the shape of a truncated cone and is applied to the protective cap, to which it forms a kind of counterpart, while its conformation makes possible a series of usages which will be made evident later in this text.

According to the invention the cleaner body is interchangeable and is made of a semi-rigid material that permits a preset flexibility of the cleaner blades, such flexibility being due also to the special scraper-blade conformation of the cleaner blades themselves.

The invention is therefore embodied in a lavatory brush consisting of a brush and of a container, the lavatory brush being characterized in that it comprises a plurality of blades conformed so as to become thinner radially with a tract having parallel faces.

Figure 1:
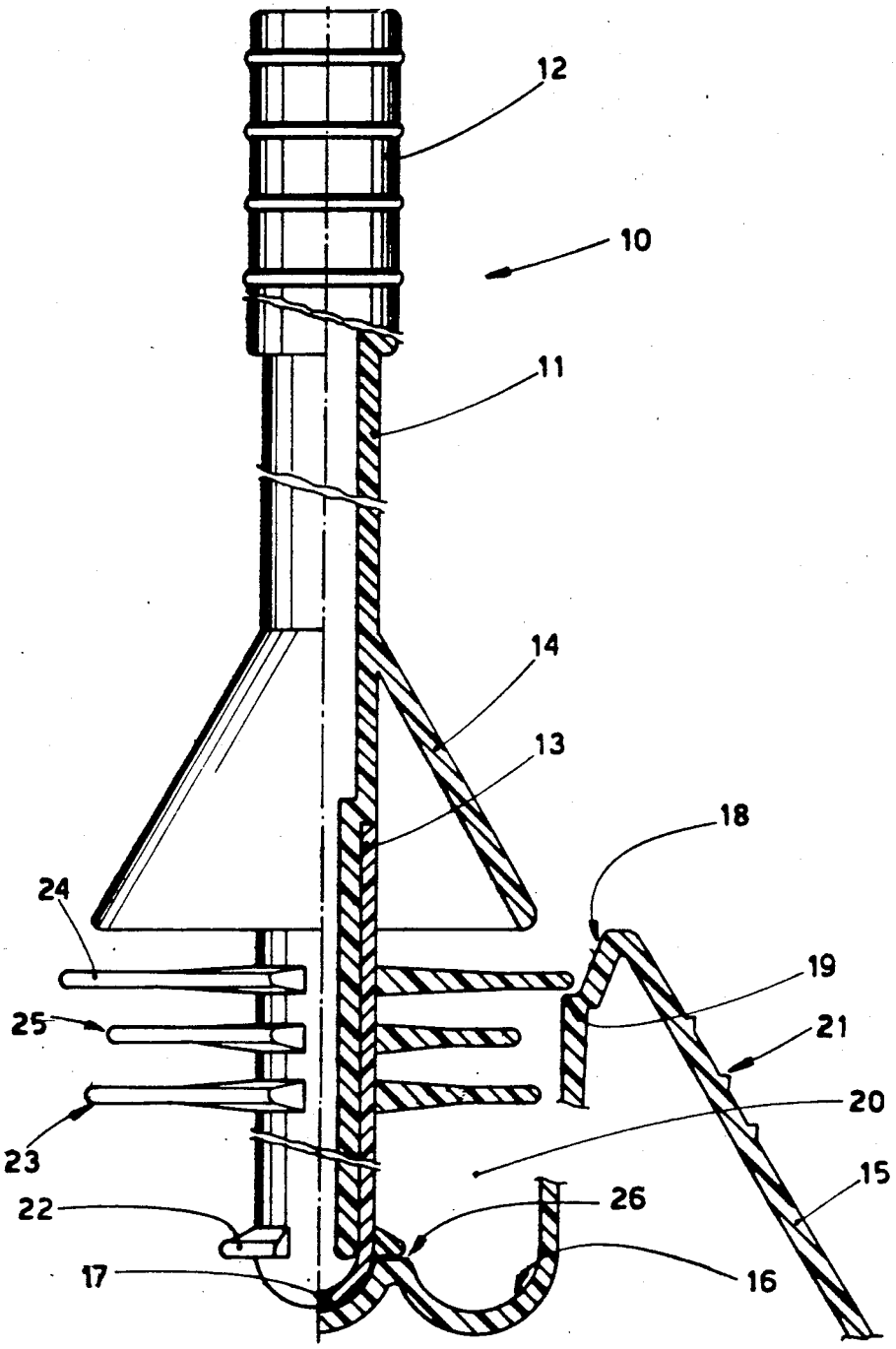

Let us now see a preferred embodiment of the invention as a non-restrictive example with the help of the attached figures, in which:

FIG. 1 shows a cutaway half-section of a formulation of the invention;

FIG. 1*a* shows a modification of FIG. 1 in which the cleaning blades are coiled in a spiral;

FIG. 1*b* shows a modification of FIG. 1 in which the handgrip is inclined with respect to the handle.

Figure 2:
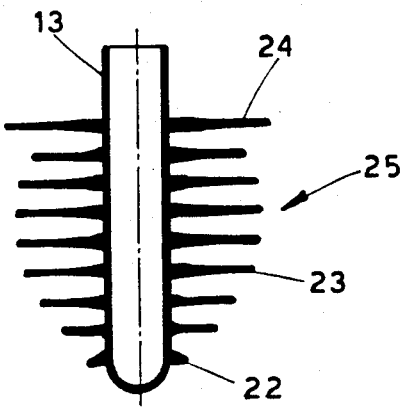

FIG. 2 shows a preferred embodiment of the cleaner body;

FIGS. 3*a–g* give some examples of cleaner blades.

In the figures a brush 10 has a handle 11 with a handgrip 12 comprising engagement elements such as projections, recesses, ridges, teeth, etc.

The handgrip 12 can be on the same axis as the handle 11 or slightly inclined thereto, such inclination being able to reach about 30°.

The handle 11 comprises in a downward direction a protective cap 14 and a terminal tapered portion onto which an interchangeable body 13 is fitted. Such interchangeable body 13 comprises an alignment closure blade 24 and a cleaner body 25.

This cleaner body 25 consists advantageously of a plurality of cleaner blades 23 arranged according to the configuration of a ball or pine-cone and ending below advantageously with a blade 22 that performs the twofold function of providing a support and carrying out heavy cleaning.

The brush 10 cooperates with a container 15, which comprises a lodgement space 20 2ith a toric collector-ring channel 16 and an alignment seating 17.

The alignment seating 17 cooperates with the end portion of the interchangeable body 13, while a toric circular ridge 26 positioned between the collector channel 16 and the alignment seating 17 cooperates with the support blade 22 to provide proper support and alignment.

The lodgement space 20 comprises at its upper end a support edge 19, which cooperates with the alignment blade 24, and also an inverted flared alignment portion 18 able to assist alignment of the brush 10 when the latter is being inserted into the lodgement space 20.

The container 15 may comprise decorative ridges 21 on its outside surface.

The cleaner blades 23 have a relatively strong body at the position of their attachment to the interchangeable body 13, but their further outward development becomes thinner and they have a substantially flattened portion 28 at their outer end.

Such substantially flattened portion 28 has in a radial direction a development of between 8 and 15 mm., such development being advantageously about 10 mm. and, in this case, the same for all the cleaner blades 23, but such development can be varied as required.

The support blade 22 has a lower support surface and the form substantially of a cantilever beam towards the point of its attachment to the interchangeable body 13 and is thus rendered able to perform the functions of a support and of a means to carry out heavy scraping.

Figure 3A:
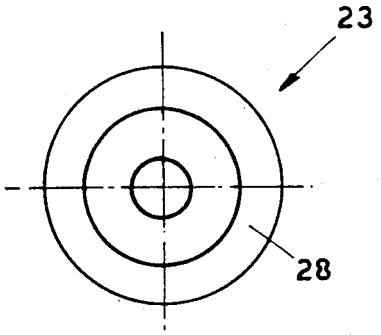
Figure 3B:
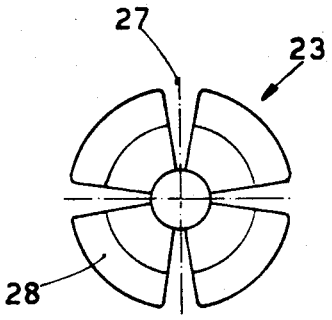
Figure 3C:
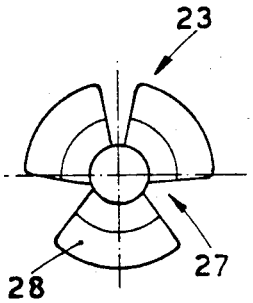
Figure 3E:
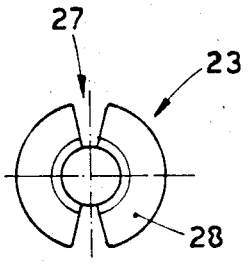
Figure 3F:
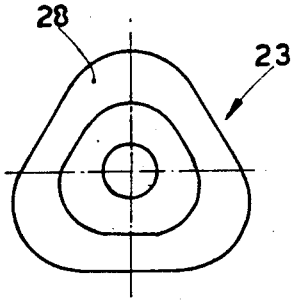
Figure 3G:
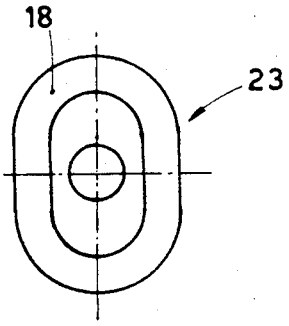

The cleaner blades 23 have a circular or torodial shape or a three-lobed shape as in FIG. 3*f*, or an ovalized shape as in FIG. 3*g*, or a rhomboidal or other shape.

The cleaner blades 23 can have a continuous form or can include vacant portions 27, which can be one, two, three, four, etc. in number and can be positioned peripherally or can affect only the flattened portion 28 of the blades or can reach the interchangeable body 13.

On one and the same interchangeable body 13 there can be blades 22–23–24 variously equipped and conformed.

The arrangement of the cleaner blades 23 on the cleaner body 25 will advantageously be such as to embody substantially a pine-cone shape or a sphere.

The alignment blade 24 has substantially the greatest diameter so as to close the lodgement space 20.

As we said earlier, the composition of the cleaner blades 22–23–24 can be varied; thus the blades 23 may be all of the same type or may have different characteristics, with one or more vacant portions 27, or may include round blades with three-lobed and/or ovoidal blades, circumferentially perfect blades or blades notched circumferentially, etc.

The cleaner blades 23 may also be positioned parallel, coiled in a spiral, inclined in relation to the handle 11 or to each other or awry.

These and other variants remain within the scope of the inventive idea.

I claim:

1. A lavatory brush set, comprising:

a brush having an elongate handle unit having a hand grip at one end portion thereof and a plurality of cleaner elements at the other end portion thereof, said cleaner elements being arranged circumferentially around the handle unit and protruding outboard away from the length axis of the handle unit, several of said cleaning elements being distributed along the handle unit in the length direction of the latter, a container including an upward opening cup having a side wall and a bottom and receiving downward thereinto said other end portion and said cleaning elements of said brush such that liquid remaining on the cleaning elements from prior cleaning can drip into the cup;

cooperating alignment means in the bottom of said cup and on the bottom of said other end portion of said handle unit interengageable for positively but releasably supporting the other end portion of said handle unit, including said cleaning elements, in said cup with said handle unit extending in an upright condition upward out of said cup without danger of the brush falling out of the container, in which said alignment means comprise an alignment seat in the bottom of the cup which laterally fixedly locates the other end portion of said handle unit with respect to the container, said alignment means further including a blade extending laterally outward from the other end portion of the handle unit and being circumferentially and supportively engaged by a circumferential surface of said cup so that the brush will stand upright within the container.

2. The apparatus of claim 1 in which the bottom of said cup contains an upstanding annular ridge surrounding said seat and defining said circumferential surface of said cup, said blade being a support blade resting atop said annular ridge, said annular ridge and seat cooperating to support and hold upright said handle unit extending upward out of said container.

3. The apparatus of claim 2 in which said support blade is of lesser diameter than said cleaning elements, said cleaning elements being located axially inward of said support blade on said handle unit, said support blade being radially smaller with respect to its axial thickness than said cleaning elements and defining a means for carrying out heavy scraping during lavatory cleaning, said support blade being located immediately axially adjacent the free end of said other end portion of said handle unit.

4. A lavatory brush set, comprising:

a brush having an elongate handle unit having a hand grip at one end portion thereof and a plurality of cleaner elements at the other end portion thereof, said cleaner elements being arranged circumferentially around the handle unit and protruding outboard away from the length axis of the handle unit, several of said cleaning elements being distributed along the handle unit in the length direction of the latter, a container including an upward opening cup having a side wall and a bottom and receiving downward thereinto said other end portion and said cleaning elements of said brush such that liquid remaining on the cleaning elements from prior cleaning can drip into the cup;

cooperating alignment means in the bottom of said cup and on the bottom of said other end portion of said handle unit interengageale for positively but releasably supporting the other end portion of said handle unit, including said cleaning elements, in said cup with said handle unit extending in an upright condition upward out of said cup without danger of the brush falling out of the container, in which said alignment means includes a blade located between said one end portion of said handle unit and said cleaning elements, said blade being close spaced to said cleaning elements and being of diameter greater than said cleaning elements, said alignment means further including a circumferential surface of said cup forming a step-like upward facing support edge located adjacent the upper end of the cup, said blade being an alignment blade resting on said support edge for (1) tending to prevent tilting of said handle unit with respect to said container and (2) substantially closing the upper end of said cup so as to reduce escape of odors from liquid clinging to said cleaning elements or which has dripped therefrom into the cup.

5. The apparatus of claim 4 in which the top of said cup flares upward and radially outward to assist guiding of the cleaning elements and alignment blade downward into the cup.

6. The apparatus of claim 1 in which said seat is a central depression in the bottom of said cup, said central depression being surrounded by an upstanding annular ridge in the bottom of said cup, the portion of the bottom of the cup between said annular ridge and the side wall of said cup being depressed below said ridge and forming an annular collector channel for receiving liquid dripping from said cleaning elements.

7. A lavatory brush set, comprising:

a brush having an elongate handle unit having a hand grip at one end portion thereof and a plurality of cleaner elements at the other end portion thereof, said cleaner elements being arranged circumferentially around the handle unit and protruding outboard away from the length axis of the handle unit, several of said cleaning elements being distributed along the handle unit in the length direction of the latter, a container including an upward opening cup having a side wall and a bottom and receiving downward thereinto said other end portion and said cleaning elements of said brush such that liquid remaining on the cleaning elements from prior cleaning can drip into the cup;

cooperating alignment means in the bottom of said cup and on the bottom of said other end portion of said handle unit interengageable for positively but releasably supporting the other end portion of said handle unit, including said cleaning elements, in said cup with said handle unit extending in an upright condition upward out of said cup without danger of the brush falling out of the container, in which said container has an outward and downward flaring frustoconical side wall connected to the upper circumferential edge of the cup, said alignment means including an alignment blade extending laterally outward from said handle unit between said one end portion of said handle unit and said cleaning elements, said alignment blade being located axially close to said cleaning elements, and a substantially frustoconical cap fixed on said handle unit between said alignment blade and said hand grip, said cap having its larger diameter end located close to said alignment blade and being of diameter of less than said alignment blade, said cap limiting the deflection of said alignment blade axially toward said hand grip during heavy cleaning, the taper of said cap and of said container side wall providing a kind of optical continuity from the container to the brush with the brush resting in the container.

8. A lavatory brush set, comprising a brush having an elongate handle unit having a handle defining a hand grip adjacent one end thereof and a body defining a plurality of cleaner elements adjacent the other end thereof, said cleaner elements being arranged circumferentially around the handle unit and protruding outboard away from the length axis of the handle unit, several cleaning elements being distributed along the handle unit in the length direction of the latter, in which said body comprises a laterally outwardly extending blade comprising one of said cleaning elements, the remaining cleaning elements being disposed between said blade and the other end of said handle unit, said handle carrying a cap having a maximum diameter portion axially near said blade and of diameter less than said blade, such that deflection of said blade during heavy cleaning in a direction away from the remaining cleaning elements is limited by contact of said blade axially with said cap.

9. A lavatory brush set, comprising an elongate handle having a hand grip adjacent one end thereof and a plurality of axially stacked, flexible cleaner blades adjacent the other end thereof, each blade having portions distributed circumferentially around the handle, said blades extending substantially radially outward from the handle and being of a flexible material, each blade having a root portion at which it is fixed to the handle and a peripheral portion remote from the handle, in which said blades include axially stacked cleaner blades, the diameters of said cleaner blades varying axially of said handle from a minimum diameter cleaner blade adjacent said other end of said handle to a maximum diameter cleaner blade intermediate the stack of cleaner blades and thence to an intermediate diameter cleaner blade at the end of the stack of cleaner blades furthest from said other end of said handle, the side view profile of said stack of cleaner blades, defined by the outer peripheries thereof, being convexly rounded and defining approximately a pine cone shape.

10. A lavatory brush set, comprising an elongate handle having a hand grip adjacent one end thereof and a plurality of axially stacked, flexible cleaner blades adjacent the other end thereof, each blade having portions distributed circumferentially around the handle, said blades extending substantially radially outward from the handle and being of a flexible material, each blade having a root portion at which it is fixed to the handle and a peripheral portion remote from the handle, including an alignment blade laterally extending from said handle unit adjacent the cleaner blade furthest from said other end of said handle unit, said alignment blade being of diameter greater than said cleaner blades.

11. A lavatory brush set, comprising an elongate handle having a hand grip adjacent one end thereof and a plurality of axially stacked, flexible cleaner blades adjacent the other end thereof, each blade having portions distributed circumferentially around the handle, said blades extending substantially radially outward from the handle and being of a flexible material, each blade having a root portion at which it is fixed to the handle and a peripheral portion remote from the handle, in which the smallest diameter one of said cleaner blades, which is located adjacent said other end of said handle unit, has a flat bottom facing axially towards that other end and a tapered top arranged so that the thickness of said blade at said handle unit is greater than the thickness thereof at the outer periphery thereof, such that the axial dimension of said blade is almost as great as the radial dimension thereof from said handle unit to the outer periphery of said blade, said last mentioned blade serving as a scraper for hard cleaning.

12. A lavatory brush set, comprising an elongate handle having a hand grip adjacent one end thereof and a plurality of axially stacked, flexible cleaner blades adjacent the other end theroof, each blade having portions distributed circumferentially around the handle, said blades extending substantially radially outward from the handle and being of a flexible material, each blade having a root portion at which it is fixed to the handle and a peripheral portion remote from the handle, in which the diameters of said cleaner blades vary axially of the handle, with the maximum diameter in the middle of said stack of cleaner blades, a side view of said stack of cleaner blades presenting a convexly rounded profile.

13. The apparatus of claim 10 in which the cleaner and alignment blades are arranged in a spiral.

14. The apparatus of claim 10 in which the cleaner and alignment blades are arranged parallel to each other.

15. The apparatus of claim 10 in which the cleaner and alignment blades are inclined in relation to the axis of the handle of the brush.

16. The apparatus of claim 10 in which the cleaner and alignment blades are circumferentially continuous.

17. The apparatus of claim 10 in which the cleaner and alignment blades include circumferentially vacant portions.

18. A lavatory brush set, comprising:

a brush having an elongate handle unit having a hand grip at one end portion thereof and a plurality of cleaner elements at the other end portion thereof, said cleaner elements being arranged circumferentially around the handle unit and protruding outboard away from the length axis of the handle unit, several of said cleaning elements being distributed along the handle unit in the length direction of the latter.

a container including an upward opening cup having a side wall and a bottom and receiving downward thereinto said other end portion and said cleaning elements of said brush such that liquid remaining on the cleaning elements from prior cleaning can drip into the cup;

cooperating alignment means in the bottom of said cup and on the bottom of said other end portion of said handle unit interengageable for positively but releasably supporting the other end portion of said handle unit, including said cleaning elements, in said cup with said handle unit extending in an upright condition upward out of said cup without danger of the brush falling out of the container, in which the handgrip is inclined in relation to an intermediate portion of the handle.

19. the apparatus of claim 8 in which said body is an elongate member separate from and carried on said handle, said handle being stepped radially to form a reduced diameter cylinder at its end remote from said handgrip, said body having a tubular wall and being open at one end to telescope snugly but slidably over the reduced diameter cylinder and being closed at the other end, said cleaner elements laterally protruding from the tubular wall of the body where same radially surrounds said handle, and thereby fixedly but releasably coaxially joining said handle and body as a unit for lavatory cleaning, said body being removable from said handle for replacement by a new body having new cleaning elements and to enable attachment of a longer or a shorter handle to the body to adapt the brush to different lavatory configurations.

20. The apparatus of claim 12, in which the peripheral portion of a given blade is thinner, axially of the handle, than the root portion, so that the outer periphery of the blade is more flexible axially of the handle than is the root of the blade, the blade extending in a continuous integral manner from said root to the peripheral portion thereof.

* * * * *

UNITED STATES PATENT AND TRADEMARK OFFICE

CERTIFICATE OF CORRECTION

PATENT NO. : 4 700 423

DATED : October 20, 1987

INVENTOR(S) : Alessandro ZUIANI

It is certified that error appears in the above-identified patent and that said Letters Patent is hereby corrected as shown below:

Please amend as follows:

Column 4, line 12; change "interengageale" to ---interengageable---

Column 6, line 26; change "theroof" to ---thereof---

Column 6, line 58, change "latter." to ---latter,---

Signed and Sealed this

Tenth Day of May, 1988

*Attest:*

*Attesting Officer*

DONALD J. QUIGG

*Commissioner of Patents and Trademarks*